US010804633B2

(12) United States Patent
Kato et al.

(10) Patent No.: US 10,804,633 B2
(45) Date of Patent: Oct. 13, 2020

(54) ELECTRICAL CONTACT POINT, CONNECTOR TERMINAL PAIR AND CONNECTOR PAIR

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Akihiro Kato, Yokkaichi (JP); Hajime Watanabe, Yokkaichi (JP); Yoshiyasu Tsuchiya, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/341,080

(22) PCT Filed: Oct. 11, 2017

(86) PCT No.: PCT/JP2017/036723
§ 371 (c)(1),
(2) Date: Apr. 11, 2019

(87) PCT Pub. No.: WO2018/079253
PCT Pub. Date: May 3, 2018

(65) Prior Publication Data

US 2019/0237887 A1 Aug. 1, 2019

(30) Foreign Application Priority Data

Oct. 25, 2016 (JP) ..... 2016-208354

(51) Int. Cl.
*H01R 13/02* (2006.01)
*H01R 13/03* (2006.01)
(Continued)

(52) U.S. Cl.
CPC ..... *H01R 13/03* (2013.01); *C25D 5/10* (2013.01); *C25D 5/50* (2013.01); *C25D 7/00* (2013.01); *H01R 13/187* (2013.01)

(58) Field of Classification Search
CPC ..... H01R 13/03; H01R 13/187; C25D 5/50; C25D 7/00; C25D 5/10
(Continued)

(56) References Cited

U.S. PATENT DOCUMENTS 6,239,386 B1 * 5/2001 DiStefano ..... H01R 13/2414 174/262
6,913,468 B2 * 7/2005 Dozier, II ..... B23K 20/004 257/E21.503
(Continued)

FOREIGN PATENT DOCUMENTS

JP 2010-541139 A 12/2010
JP 2011-202266 A 10/2011
JP 2013-254681 A 12/2013

OTHER PUBLICATIONS

Nov. 21, 2017 International Search Report issued in International Patent Application No. PCT/JP2017/036723.

*Primary Examiner* — Abdullah A Riyami
*Assistant Examiner* — Nelson R. Burgos-Guntin
(74) *Attorney, Agent, or Firm* — Oliff PLC

(57) ABSTRACT

An electrical contact point including: a first contact and a second contact capable of forming an electrical contact each other, wherein: the first contact includes an alloy containing layer having alloy parts made of an alloy containing tin and palladium and a tin part made of tin or an alloy having a
(Continued)

higher ratio of tin to palladium than the alloy parts with both the alloy parts and the tin part exposed on an outermost surface; and the second contact includes a dissimilar metal layer made of metal having a higher hardness than the alloy containing layer and containing neither tin nor palladium on an outermost surface.

9 Claims, 2 Drawing Sheets

(51) Int. Cl.
*C25D 5/10* (2006.01)
*C25D 7/00* (2006.01)
*C25D 5/50* (2006.01)
*H01R 13/187* (2006.01)

(58) Field of Classification Search
USPC ..... 439/887
See application file for complete search history.

(56) References Cited

U.S. PATENT DOCUMENTS

2003/0068906 A1* 4/2003 Light ..... H01L 23/49816 439/66
2005/0026476 A1* 2/2005 Mok ..... C23C 18/00 439/81
2005/0221645 A1* 10/2005 Hasegawa ..... H01R 43/007 439/86
2006/0199447 A1* 9/2006 Vicich ..... H01R 12/57 439/884
2010/0311288 A1 12/2010 Horn et al.
2011/0294368 A1* 12/2011 Nakata ..... H01R 4/184 439/887
2014/0094072 A1* 4/2014 Seki ..... H01R 13/03 439/887
2015/0133005 A1* 5/2015 Saka ..... H01R 13/03 439/887
2015/0333425 A1* 11/2015 Takahashi ..... H01R 13/03 439/887

* cited by examiner

ELECTRICAL CONTACT POINT, CONNECTOR TERMINAL PAIR AND CONNECTOR PAIR

This application is the U.S. National Phase of PCT/JP2017/036723 filed Oct. 11, 2017, which claims priority to JP 2016-208354 filed Oct. 25, 2016, the entire disclosure of which is incorporated herein by reference.

BACKGROUND

The present disclosure relates to an electrical contact point, a connector terminal pair and a connector pair, more particularly to an electrical contact point having an alloy containing layer containing palladium on a surface of one of a pair of contact points configured to electrically contact each other and a connector terminal pair and a connector pair having such electrical contact points.

A contact portion of a connector terminal for connecting an electrical component of an automotive vehicle or the like is required to show a low contact resistance. Generally, a tin plating layer is often formed on a surface of a connector terminal. The tin plating layer provides a very low contact resistance and can form a good electrical connection. However, since tin is very soft and has a property of easy adhesion, a friction coefficient becomes high on the contact portion of the connector terminal having tin plating applied thereto and an insertion force required to insert and fit the connector terminal becomes large. Particularly, an electronic control of an automotive vehicle has become complicated due to self-driving technique in recent years, and the number of terminals constituting one connector tends to increase. As the number of terminals constituting a connector increases, an insertion force of the entire connector increases. Thus, an importance of reducing an insertion force in each terminal is increasing.

A connector terminal designed to combine a low insertion force and a low contact resistance by reducing a friction coefficient is disclosed, for example, in Japanese Unexamined Patent Publication No. 2011-202266. Japanese Unexamined Patent Publication No. 2011-202266 discloses a fitting-type connection component in which a copper-tin alloy coating layer and a tin coating layer are formed in this order as surface plating layers on a copper plate material having surface roughening applied thereto and the copper-tin alloy coating layer and the tin coating layer are mixed in a predetermined pattern on an outermost surface on a contact side with a mating component. Here, the tin coating layer contributes to a low contact resistance and the copper-tin coating layer contributes to a reduction of a terminal insertion force by reducing a friction coefficient.

SUMMARY

As described in Japanese Unexamined Patent Publication No. 2011-202266, tin providing a low contact resistance and another type of metal providing a low friction coefficient by having a high hardness such as copper-tin alloy are exposed on the outermost surface of the contact portion of the connector terminal in a mixed manner, whereby it is possible to combine an improvement of connection reliability by reducing the contact resistance and a reduction of the insertion force by reducing the friction coefficient in a certain level. In Japanese Unexamined Patent Publication No. 2011-202266, in evaluating the friction coefficient, a coating layer in which tin and copper-tin alloy as described above are exposed in a mixed manner is formed on a surface of one of a pair of contact points configured to electrically contact each other, and a material plated with copper and tin and having a reflow process applied thereto is used as another contact point. Then, the both contact points are slid against each other. In this case, parts of tin exposed on the outermost surfaces of the both contact points contact each other. Tin has a property of easy adhesion as described above and the friction coefficient between the contact points possibly increases due to the mutual adhesion of tin between the contact points. Particularly, since an actual connector terminal is inserted and fit while a pair of contact points slide against each other, the friction coefficient between the contact points more increases due to the proceeding adhesion of tin in that sliding process.

An exemplary aspect of the disclosure provides an electrical contact point capable of combining a low friction coefficient and a low contact resistance even after a sliding movement and a connector terminal pair and a connector pair including such an electrical contact point.

To achieve the above object, an electrical contact point according to the present disclosure is composed of a first contact and a second contact capable of forming an electrical contact each other, wherein the first contact includes an alloy containing layer having alloy parts made of an alloy containing tin and palladium and a tin part made of tin or an alloy having a higher ratio of tin to palladium than the alloy parts with both the alloy parts and the tin part exposed on an outermost surface, and the second contact includes a dissimilar metal layer made of metal having a higher hardness than the alloy containing layer and containing neither tin nor palladium on an outermost surface.

Here, the dissimilar metal layer may be made of nickel or nickel alloy.

Further, the alloy parts may be diffused in the tin part in the alloy containing layer. The content of palladium to a total amount of tin and palladium may be 7 atom % or lower in the alloy containing layer. A volume ratio of the alloy parts occupying the entire alloy containing layer may be 1.0 volume % or higher and 95 volume % or lower. An area ratio of the alloy parts occupying the outermost surface of the first contact may be 1.0% or higher and 95% or lower.

One of the first and second contacts may be a bulging contact having a bulging shape on a surface side, and the other may be a plate-like contact having a plate-like shape and configured to electrically contact a top part of the bulging contact.

A connector terminal pair according to the present disclosure includes a pair of connector terminals configured to electrically contact each other on contact portions, wherein the contact portions include the electrical contact point as described above.

A connector pair according to the present disclosure includes the connector terminal pair as described above.

In the above electrical contact point according to the present disclosure, the alloy containing layer in which both the alloy parts made of the alloy containing tin and palladium and the tin part are exposed on the outermost surface is formed on a surface of the first contact. Thus, an effect of reducing a friction coefficient by the alloy parts having a high hardness and an effect of reducing contact resistance by the tin part are simultaneously obtained on the surface of the first contact. Since the dissimilar metal layer, which is a metal layer having a higher hardness than the alloy containing layer of the first contact, is formed on a surface of the second contact, a particularly high effect of reducing the friction coefficient is obtained at a contact position with the alloy containing layer, particularly at contact positions with the alloy parts. Further, since this metal layer having a high hardness is the dissimilar metal layer containing neither one of tin and palladium, which are metals forming the alloy containing layer of the first contact, adhesion having a tendency to occur between metals of the same type particularly including tin hardly occurs between the first and second contacts. In this way, a particularly high effect of reducing the friction coefficient is obtained. Since a phenomenon in which adhesion between metals of the same type proceeds does not occur even after sliding movements between the first and second contacts, a low friction coefficient is maintained.

If the dissimilar metal layer is made of nickel or nickel alloy, the friction coefficient between the first and second contacts is easily suppressed low since nickel and nickel alloy have a high hardness. Oxide films difficult to peel off are formed on surfaces of nickel and nickel alloy, but these oxide films can be peeled off during a sliding movement since the alloy parts exposed on the outermost surface of the first contact have a high hardness. Thus, a good electrical contact having a small contact resistance is easily formed between the first and second contacts.

Further, if the alloy parts are diffused in the tin part in the alloy containing layer, both the alloy parts and the tin part are easily exposed on the outermost surface of the first contact and easily brought into contact with the dissimilar metal layer of the second contact in regions of contact portions between the first and second points.

If the content of palladium to the total amount of tin and palladium may be 7 atom % or lower in the alloy containing layer, the effect of reducing the friction coefficient brought about by the exposure of the alloy parts on the outermost surface of the first contact is easily utilized while the content of palladium is suppressed low.

If the volume ratio of the alloy parts occupying the entire alloy containing layer is 1.0 volume % or higher and 95 volume % or lower or if the area ratio of the alloy parts occupying the outermost surface of the first contact is 1.0% or higher and 95% or lower, the effect of reducing the friction coefficient by the alloy parts and the effect of reducing the contact resistance by the tin part are easily combined.

If one of the first and second contacts is the bulging contact having the bulging shape on the surface side and the other is the plate-like contact having the plate-like shape and configured to electrically contact the top part of the bulging contact, a low friction coefficient and a low contact resistance can be combined in contacts having a small area and formed between the top part of the bulging contact and the plate-like contact and high connection reliability and a low insertion force can be combined in connector terminals of a general fitting type or the like.

Since the connector terminal pair according to the present disclosure includes the electrical contact point composed of the first and second contats including specific metal layers as described above on surfaces, a low contact resistance and a low friction coefficient can be combined by avoiding adhesion between metals of the same type including tin on contact portions. In this way, high connection reliability and a low insertion force can be combined in the connector terminals.

Since the connector pair according to the present disclosure includes the connector terminal pair as described above, a low contact resistance and a low friction coefficient can be combined by avoiding adhesion between metals of the same type including tin on the contact portions of each connector terminal pair. In this way, even if the number of the connector terminal pairs constituting the connector pair increases, an increase of an insertion force can be suppressed while high connection reliability is ensured.

DETAILED DESCRIPTION OF EMBODIMENTS

Hereinafter, an embodiment of the present disclosure is described in detail using the drawings.

[Electrical Contact Point]

An electrical contact point according to one embodiment of the present disclosure is composed of a pair of a first contact point 10 and a second contact point 20. The first and second contact points 10, 20 can electrically contact each other on surfaces thereof.

The first and second contact points 10, 20 may be of any shape. As an example, one of these contacts can be configured as a bulging contact point having a bulging shape such as an embossed shape. The other can be configured as a plate-like contact point such as flat plate-like contact point. In this case, the bulging contact point electrically contacts a surface of the plate-like contact point on a top part of the bulging shape. A combination of such contact points is often used in male and female fitting terminals as described on the basis of FIG. 2 later. Which of the first and second contact points 10, 20 is formed into a bulging contact point and which of the first and second contact points 10, 20 is formed into a plate-like contact may be arbitrarily selected, but a case where the first contact point 10 is the bulging contact and the second contact point 20 is the plate-like contact is described as an example below.

Figure 1A:
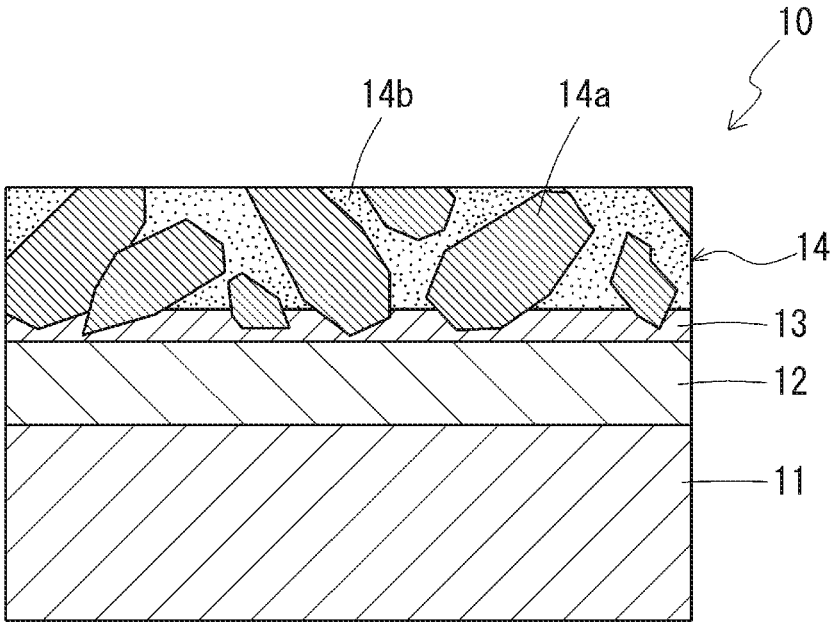
FIG. 1 are sections schematically showing layer structures by two types of materials constituting an electrical contact point according to one embodiment of the present disclosure, wherein (a) shows a structure in which an alloy containing layer on a first contact point is exposed and (b) shows a structure in which a dissimilar metal layer is exposed on a second contact point.
Figure 1B:
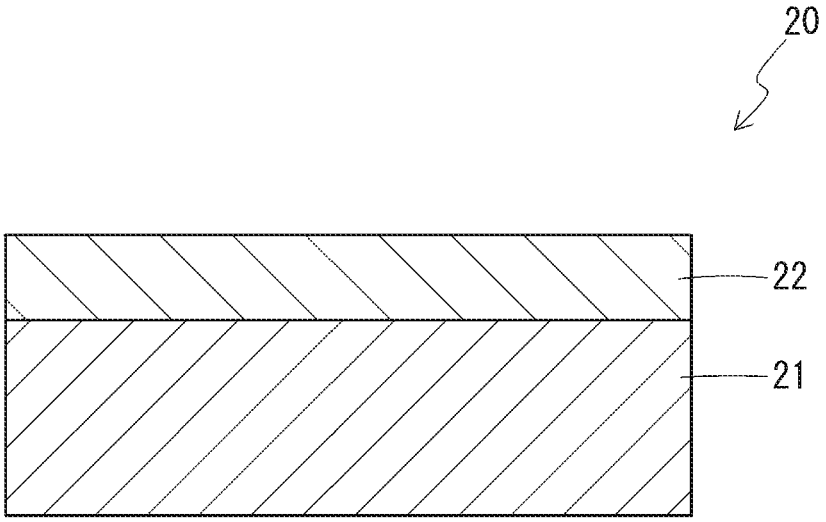

As shown in FIG. 1(*a*), a tin-palladium alloy coating layer (hereinafter, merely referred to as an alloy containing layer in some cases) composed of tin-palladium alloy parts (hereinafter, merely referred to as alloy parts in some cases) 14*a* and a tin part 14*b* is exposed on an outermost surface of the first contact point 10. As shown in FIG. 1(*b*), a dissimilar metal layer 22 is exposed on an outermost surface of the second contact point 20. The first and second contact points 10, 20 contact each other on surfaces of the alloy containing layer 14 and the dissimilar metal layer 22 thereof. In the first contact point 10, both the alloy parts 14 and the tin part 14*b* are exposed on the outermost surface in an actual contact surface, which is a region which actually contacts the second contact point 20. Materials constituting the first and second contact points 10, 20 are successively described in detail below.

(Material Composition of First Contact Point)

As shown in FIG. 1(*a*), the alloy containing layer 14 is appropriately formed on a surface of a backing material 11 across an underlayer 12 in the first contact point 10.

The backing material 11 serves as a base material of the first contact point 10 and is, for example, copper, aluminum, iron or an alloy mainly containing one of these metals. Out of these, copper or copper alloy generally used as a backing material of connection terminals is particularly preferable since having a high conductivity.

The alloy containing layer 14 is comprised of the alloy parts 14*a* made of an alloy mainly containing tin and palladium and the tin part 14*b* made of pure tin or an alloy having a higher ratio of tin than the alloy parts 14*a*. The alloy parts 14*a* and the tin part 14*b* are both exposed on the outermost surface of the alloy containing layer 14. In the alloy containing layer 14, the alloy parts 14*a* and the tin part 14*b* may be distributed in any pattern as long as these are both exposed on the outermost surface. However, it is preferable that the alloy parts 14*a* are distributed in the tin part 14*b*, i.e. the alloy parts 14*a* are segregated in the form of particles and distributed in a sea-island manner in the tin part 14*b*.

As described above, on the outermost surface of the alloy containing layer 14, both the alloy parts 14*a* and the tin part 14*b* of the alloy containing layer 14 of the first contact point 10 contact the dissimilar metal layer 22 on the outermost surface of the second contact point 20. At this time, in the alloy containing layer 14, the alloy parts 14*a* having a high hardness function to reduce a friction coefficient between the alloy containing layer 14 and the dissimilar metal layer 22. On the other hand, the tin part 14*b* soft and having a high conductivity functions to reduce contact resistance with the dissimilar metal layer 22.

The alloy parts 14*a* are made of an intermetallic compound (tin-palladium based alloy) containing tin and palladium. The intermetallic compound may be a binary alloy composed only of tin and palladium or a multi-component alloy containing other metal(s) besides tin and palladium. In the case of the binary alloy, the intermetallic compound has a composition of $PdSn_4$. Examples of metal elements constituting the multi-component alloy other than tin and palladium include metal elements contained in the backing material 11 and/or the underlayer 12. If the underlayer 12 is made of nickel or nickel alloy, a ternary alloy having a composition of $(Ni_{0.4}Pd_{0.6})Sn_4$ tends to be formed. Note that, regardless of whether the intermetallic compound is the binary alloy or the multi-component alloy, the alloy parts 14*a* may contain a small amount of metal elements constituting the backing material 11 and/or the underlayer 12, unavoidable impurities, phases of palladium not taken into the alloy and the like in addition to the intermetallic compound.

The underlayer 12 is preferably made of nickel or nickel alloy. The underlayer 12 made of nickel or nickel alloy functions to hold the alloy containing layer 14 in closer contact with the backing material 10 and suppress the diffusion of metal atoms from the backing material 11 to the alloy containing layer 14. A part of the underlayer 12 on the side of the alloy containing layer 14 may become a nickel-tin alloy layer 13 by heating in a step of forming the alloy containing layer 14. The nickel-tin alloy layer 13 has a composition of $Ni_3Sn_4$. A remaining part of the underlayer 12 is in a state of nickel or nickel alloy without being alloyed with tin. By forming the nickel-tin alloy layer 13, the diffusion of metal atoms from the backing material 11 to the alloy containing layer 14 is firmly suppressed even at high temperature, whereby it is suppressed that metal atoms diffuse from the backing material 11 to the alloy containing layer 14 at high temperature and contact resistance increases on the oxidized outermost surface due to oxidation. Partial regions of the particles of the alloy parts 14*a* on the side of the underlayer 12 are fit in the nickel-tin alloy layer 13 and surrounded by a nickel-tin alloy.

In terms of sufficiently exhibiting an effect of reducing the friction coefficient, the content of palladium to the total amount of tin and palladium (Pd/(Sn+Pd)×100%) is preferably 1 atom % or higher, particularly 2 atom % or higher and further 4 atom % or higher in the entire alloy containing layer 14, i.e. the entire alloy containing layer 14 as the sum of the alloy parts 14*a* and the tin part 14*b*. On the other hand, as described above, a stable composition of the binary alloy between tin and palladium is $PdSn_4$. In terms of stably forming a state where the alloy parts 14*a* and the tin part 14*b* coexist, the content of palladium is preferably below 20 atom %. If the alloy parts 14*a* are made of a multi-compound alloy, it is better to determine an upper limit for the content of palladium in consideration of the composition of that multi-compound alloy so that tin coexists as the tin part 14*b* without entirely becoming the alloy parts 14*a*. Further, in terms of sufficiently securing the tin part 14*b* and effectively reducing the contact resistance by the tin part 14*b*, the content of palladium is particularly preferably 7 atom % or lower.

Further, to effectively reduce the friction coefficient, a volume ratio of the alloy parts 14*a* occupying the entire alloy containing layer 14 is 1.0 volume % or higher, more preferably 50 volume % or higher. On the other hand, in terms of securing a ratio of the tin part 14*b* and sufficiently obtaining an effect of reducing the contact resistance, a volume ratio of the alloy parts 14*a* may be 95 volume % or lower. Note that the volume ratio of the alloy parts 14*a* occupying the entire alloy containing layer 14 is calculated by (volume occupied by the alloy parts 14*a* in the alloy containing layer 14)/(entire volume of the alloy containing layer 14)×100%.

Similarly, to effectively reduce the friction coefficient, an area ratio (exposed area ratio) of the alloy parts 14*a* occupying the outermost surface of the alloy containing layer 14 may be 1.0% or higher, more preferably 20% or higher. On the other hand, in terms of securing the ratio of the tin part 14*b* and sufficiently obtaining the effect of reducing the contact resistance, the area ratio of the alloy parts 14*a* occupying the outermost surface may be 95% or lower. Note that the area ratio of the alloy parts 14*a* occupying the outermost surface is calculated by (area of the alloy parts 14*a* exposed on the surface)/(area of the entire surface of the alloy containing layer 14)×100%.

In terms of sufficiently exhibiting a property of the alloy containing layer 14 to combine a reduction of the friction coefficient on the surface and a reduction of the friction coefficient, a thickness of the entire alloy containing layer 14 is preferably 0.8 μm or larger.

A surface hardness of the alloy containing layer 14 is generally within a range of 50 to 200 Hv. Here, the hardness of the alloy containing layer 14 is a hardness measured in the entire region of the actual contact surface where the first contact point 10 actually contacts the second contact point 20, i.e. a hardness measured for the surface including both the alloy parts 14*a* and the tin part 14*b* coexisting and exposed. Note that a hardness of only the tin part 14*b* is about 10 to 50 Hv.

As described above, in the alloy containing layer 14, both the alloy parts 14*a* and the tin part 14*b* need to be exposed on the outermost surface in the actual contact surface where the first and second contact points 10, 20 actually contact. Thus, the particles of the alloy parts 14*a* on the exposed surface preferably have suitable diameters in comparison to the area of the actual contact surface. If the particle diameters are too small, there is a possibility that only continuous regions of the tin part 14*b* are exposed in the actual contact surface. On the other hand, if the particle diameters are too large, there is a possibility that only the alloy parts 14*a* are exposed in the actual contact surface. Specifically, the particle diameters are preferably 0.5 μm or larger and 1.5 μm or smaller.

The alloy containing layer 14 can be formed, for example, by laminating a palladium layer and a tin layer in this order on the surface of the backing material 11 appropriately formed with the underlayer 12 and forming an alloy by heating. Alternatively, a plating solution containing both tin and palladium may be used to form the alloy containing layer 14 by eutectoid. In terms of convenience, the former method of alloying after the palladium layer and the tin layer are laminated is preferable. Parameters such as the volume ratio, the area ratio on the outermost surface and the particle diameters of the alloy parts 14*a* in the alloy containing layer 14 can be controlled by adjusting thicknesses of the palladium layer and the tin layer before the formation of the alloy and a heating temperature and a heating time during the formation of the alloy. For example, an adjustment of the thickness of the palladium layer in a range of 0.01 to 0.03 μm can be illustrated. In this case, the thickness of the tin layer may be set at about 1 μm.

(Material Composition of Second Contact Point)

In the second contact point 20, the dissimilar metal layer 22 is formed to cover a surface of a backing material 21 and be exposed on the outermost surface as shown in FIG. 1(*b*).

The backing material 21 serves as a base material of the second contact point 20 and may be made of any metal material similarly to the backing material 11 of the first contact point 10. Copper or copper is illustrated as a suitable example. Alternatively, the backing material 21 may be made of aluminum, aluminum alloy, iron or iron alloy.

The dissimilar metal layer 22 is made of metal containing neither tin nor palladium. Here, containing neither tin nor palladium means not only a case where tin and palladium are not contained at all, but also a case where one or both of them are contained in such a concentration as to be regarded as unavoidable impurities.

The dissimilar metal layer 22 has a higher hardness than the alloy containing layer 14 of the first contact point 10. Here, the hardness of the alloy containing layer 14 to be compared is a hardness measured for the entire actual contact surface where the first contact point 10 actually contacts the second contact point 20, i.e. a hardness measured for the surface including both the alloy parts 14*a* and the tin part 14*b* coexisting and exposed as described above. As described above, preferably, the hardness of the alloy containing layer 14 is in the range of about 50 to 200 Hv and the hardness of the dissimilar metal layer 22 is preferably in the range of 200 to 1000 Hv. Since the hardness of the dissimilar metal layer 22 is in such a range, the friction coefficient with the alloy containing layer 14 of the first contact point 10, particularly with the alloy parts 14*a*, can be made sufficiently low. Further, an increase of the contact resistance due to the formation of an oxide film having a high hardness is easily avoided on the surface of the second contact point 20.

A specific composition of the dissimilar metal layer 22 is not particularly designated, but a case where the dissimilar metal layer 22 is made of nickel or nickel alloy can be a preferable example. For example, nickel has a high hardness of about 500 to 600 Hv. Nickel and nickel alloy have a relatively high conductivity among various metals. Although nickel or nickel alloy is oxidized on a surface, the progress of oxidation is suppressed to the vicinity of a surface layer. Thus, if only a relatively thin oxide film on the surface is peeled off, a good electrical contact can be formed. Preferable examples of the composition of nickel alloy include nickel-phosphorus alloy and nickel-boron alloy.

Further, examples of metal types usable as the dissimilar metal layer 22 besides nickel and nickel alloy include chromium and chromium alloy. The dissimilar metal layer 22 is preferably composed of a layer of a single type of metal in terms of configuration simplicity, but a plurality of types of metals may coexist and be exposed on the outermost surface. However, in that case, all types of metals exposed on the outermost surface need to contain neither tin nor palladium and have a higher hardness than the alloy containing layer 14.

A thickness of the dissimilar metal layer 22 may be set equal to or larger than a thickness at which a reduction of the friction coefficient by the hardness can be effectively achieved. However, it is preferable to suppress the thickness to such an extent that breakage and the like do not occur due to the hardness of the dissimilar metal layer 22 in a manufacturing process. For example, if the dissimilar metal layer 22 is made of nickel or nickel alloy, the thickness thereof is preferably set at 0.5 μm or larger and suppressed to 5 μm or smaller.

(Properties of Electrical Contact Point)

As described above, this electrical contact point is composed of the first contact point 10 including the alloy containing layer 14 in which the alloy parts 14*a* and the tin part 14*b* are exposed on the outermost surface and the second contact point 20 in which the dissimilar metal layer 22 is exposed on the outermost surface. The dissimilar metal layer 22 of the second contact point 20 contacts both the alloy parts 14*a* and the tin part 14*b* of the first contact point 10 to electrically connect the both contact points 10, 20.

In the first contact point 10, the alloy parts 14*a* made of tin-palladium based alloy having a high hardness and difficult to adhere are exposed on the outermost surface. Thus, a low friction coefficient with the second contact point 20 is obtained. Since the tin part 14*b* is exposed on the outermost surface of the first contact point 10 together with the alloy parts 14*a*, a low contact resistance with the second contact point 20 is obtained due to effects brought about by the softness and a high conductivity of tin and easiness to break of the surface oxide film.

Further, the dissimilar metal layer 22 having a high hardness is exposed on the outermost surface of the second contact point 20, whereby the friction coefficient with the first contact point 10, particularly with the alloy parts 14*a* can be effectively reduced. In addition, since the dissimilar metal layer 22 contains neither one of tin and palladium, which are metal elements constituting the alloy containing layer 14 exposed on the surface of the first contact point 10, adhesion hardly occurs when the dissimilar metal layer 22 slides against the first contact point 10. Generally, adhesion easily occurs between metals of the same type. Particularly, if two contact points slide against each other, such adhesion easily proceeds. By making the metal exposed on the outermost surface of the second contact point 20 different in type from the metals exposed on the outermost surface of the first contact point 10, adhesion between metals of the same type and an increase of the friction coefficient due to that are easily avoided. Particularly, soft tin very easily adheres to the same type of metal. However, since the dissimilar metal layer 22 of the second contact point 20 contains no tin, the occurrence of adhesion to the tin part 14*b* of the first contact point 10 and the progress of adhesion associated with a sliding movement are easily avoided. By avoiding the occurrence and progress of the adhesion of metals of the same type between the both contact points, a reduction of the friction coefficient can be achieved.

Since not only nickel and nickel alloy, but also the dissimilar metal layer 22 has a higher hardness than the alloy containing layer 14 of the first contact point 10, a hard oxide film difficult to peel off is often formed on the surface of the dissimilar metal layer 22. This is because hard transition metal is generally easily oxidized and the harder unoxidized metal is, the harder an oxide of that metal tends to be. However, since the alloy containing layer 14 of the first contact point 10, particularly the alloy parts 14*a* have a relatively high hardness, the oxide film formed on the surface of the dissimilar metal layer 22 is easily peeled off by the alloy containing layer 14 of the first contact point 10, particularly by the alloy parts 14*a* when the first and second contact points 10, 20 slide against each other. In this way, a metal surface of the dissimilar metal layer 22 is exposed and a good electrical contact can be formed with the first contact point 10. As also described above, an excellent electrical contact can be formed if a very thin oxide film is peeled off particularly when the dissimilar metal layer 22 is made of nickel or nickel alloy.

As described above, by forming an electrical contact point by combining the first contact point 10 including the alloy containing layer 14 in which both the alloy parts 14*a* made of tin-palladium based alloy and the tin part 14*b* are exposed on the outermost surface and the second contact point 20 in which the dissimilar metal layer 22 made of nickel or nickel alloy is exposed on the outermost surface, a low friction coefficient can be achieved by avoiding an increase of the friction coefficient particularly due to the occurrence of adhesion between metals of the same type and the progress of adhesion during a sliding movement on that electrical contact point. Simultaneously, a low contact resistance can be achieved and a good electrical contact can be formed. A dynamic friction coefficient on the electrical contact point is particularly preferably 0.3 or lower, more preferably 0.25 or lower. Further, the contact resistance is particularly preferably 1.0 mΩ, more preferably 0.8 mΩ or lower.

As described above, the shapes of the first and second contact points 10, 20 are not particularly limited. In the case of a combination of a bulging contact point and a plate-like contact point, either one of the first and second contact points 10, 20 may be used as the bulging contact point or the plate-like contact point.

[Connector Terminal Pair]

Figure 2:
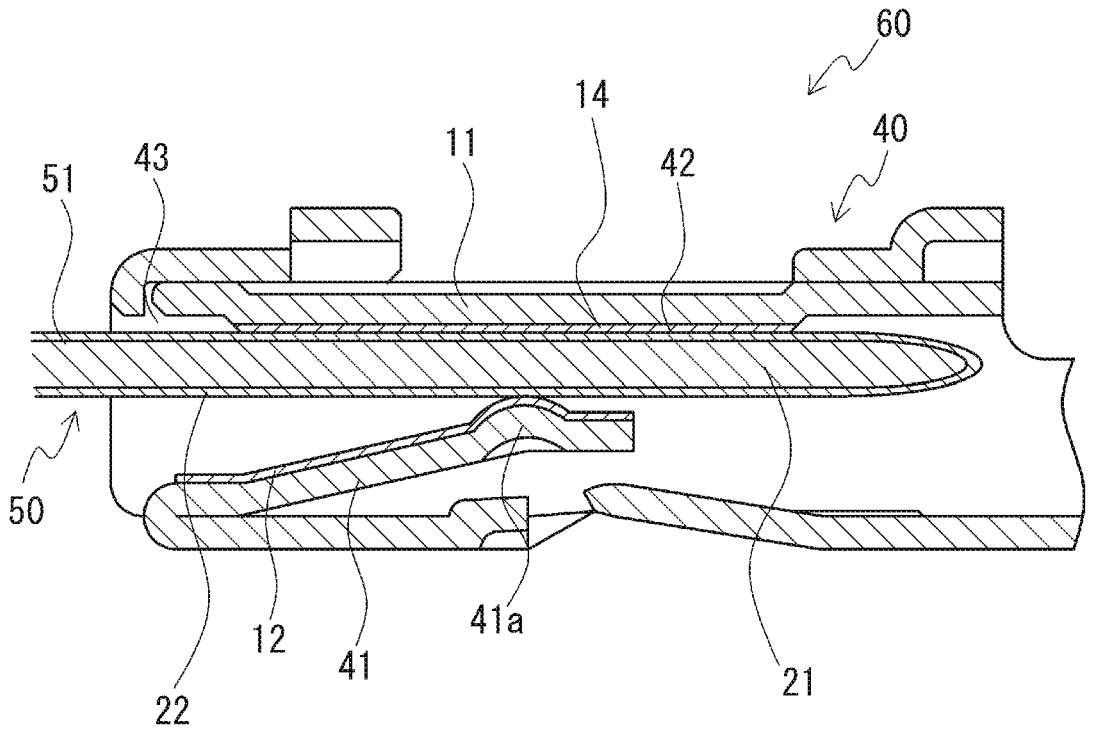
FIG. 2 is a section schematically showing a connector terminal pair according to the one embodiment of the present disclosure.

A connector terminal pair according to the one embodiment of the present disclosure includes the electrical contact point as described above, which is composed of the first contact point 10 including the alloy containing layer 14 in which the alloy parts 14*a* and the tin part 14*b* are exposed on the outermost surface and the second contact point 20 in which the dissimilar metal layer 22 is exposed, on contact portions where a pair of connector terminals electrically contact each other. The connector terminal pair may be of any type and shape as a whole as long as it includes such an electrical contact point. As an example, a connector terminal pair 60 according to the one embodiment of the present disclosure is a fitting type and composed of a pair of a female connector terminal 40 and a male connector terminal 50 as shown in FIG. 2. The electrical contact point as described above is included in the contact portions where the female connector terminal 40 and the male connector terminal 50 electrically contact each other. Specifically, the contact portion of the female connector terminal 40 is formed by the first contact point 10 in which the alloy containing layer 14 is exposed on the surface and the contact portion of the male connector terminal 50 is formed by the second contact point 20 in which the dissimilar metal layer 22 is exposed on the surface.

The female and male connector terminals 40, 50 are shaped similarly to female and male connector terminals of a known fitting type. Specifically, the female connector terminal 40 is formed with a pressing portion 43 in the form of a rectangular tube open forward, and a resilient contact piece 41 is formed on an inner side of a bottom surface of the pressing portion 43 by being folded inwardly to extend rearward. On the other hand, the male connector terminal 50 includes a tab 51 in the form of a flat plate on a front side. When the tab 51 of the male connector terminal 50 is inserted into the pressing portion 43 of the female connector terminal 40, the resilient contact piece 41 of the female connector terminal 40 contacts the male connector terminal 50 on an embossed portion 41*a* bulging inwardly of the pressing portion 43 to apply an upward force to the male connector terminal 50. A surface of a ceiling part of the pressing portion 43 facing the resilient contact piece 41 serves as an inner facing contact surface 42, whereby the male connector terminal 50 is pressed against the inner facing contact surface 42 by the resilient contact piece 41 to press and hold the male connector terminal 50 in the pressing portion 43. That is, the electrical contact points are formed between the embossed portion 41*a* and the inner facing contact surface 42 of the female connector terminal 40 and the surfaces of the tab 51 of the male connector terminal 51.

Here, as shown in FIG. 2, the alloy containing layer 14 (and the underlayer 12 and the nickel-tin alloy layer 13, not shown) is formed at least on the surface of the embossed portion 41*a* of the resilient contact piece 41 and the inner facing contact surface 42, out of the backing material 11 forming the female connector terminal 40. The dissimilar metal layer 22 is formed on surfaces to be brought into contact with the embossed portion 41*a* and the inner facing contact surface 42, out of surfaces of the backing material 21 forming the male connector terminal 50. That is, the electrical contact points according to the embodiment of the present disclosure are formed between the embossed portion 41*a* and the inner facing contact surface 42 of the female connector terminal 40 and the surfaces of the tab 51 of the male connector terminal 50.

In this way, when the tab 51 of the male connector terminal 50 is inserted into the pressing portion 43 of the female connector terminal 40 and slid, both a low friction coefficient and a low contact resistance are combined in the contact portions between the female connector terminal 40 and the male connector terminal 50. As a result, high connection reliability and the suppression of a necessary insertion force at the time of connection are combined in the connector terminal pair 60.

Note that the alloy containing layer 14 and the dissimilar metal layer 22 may be formed in wider regions of the respective connector terminals 40, 50. In a widest case, these layers can cover the entire surfaces of the backing materials 11, 21 constituting the both connector terminals 40, 50. Further, the connector terminal pair may be of any type and shape. A combination of a through hole formed in a printed board and a press-fit terminal to be press-fit and connected to that through hole can be illustrated as an example.

[Connector Pair]

The connector pair according to the one embodiment of the present disclosure includes the connector terminal pair as described above. That is, the connector pair is formed such that each connector terminal constituting the connector terminal pair as described above is accommodated and fixed in a connector housing made of an insulating material. For example, the connector terminals of the connector terminal pair can be connected to each other by connecting a pair of the connector housings constituting the connector pair to each other. The connector pair may include only one connector terminal pair or a plurality of connector terminal pairs. Further, in the case of providing a plurality of connector terminal pairs, all the connector terminal pairs may be the connector terminal pairs each including the first contact point 10 and the second contact point 20 having the specific material compositions as described above or only some of them may be such connector terminal pairs.

Since the connector pair includes the connector terminal pair including the first contact point 10 and the second contact point 20 having the specific material compositions as described above, high connection reliability by a low contact resistance and a low insertion force by a low friction coefficient are combined in the connector pair. Particularly, when the connector pair includes a plurality of connector terminal pairs, a significance of reducing the insertion force becomes large. Generally, as the number of the connector terminal pairs increases, a total insertion force in the connector pair increases. This is because the insertion force can be suppressed to low as a whole connector pair by achieving a lower insertion force in each connector terminal pair constituting the connector pair.

EXAMPLES

The present disclosure is described in detail using Examples.

[Fabrication of Plated Samples]

A tin plated sample, a tin-palladium plated sample and a nickel plated sample were fabricated by performing electrolytic plating on clean surfaces of copper boards. A film thickness of each plating layer is shown in Table 1. For the tin-palladium plated sample, a palladium plating layer and a tin plating layer were formed in this order to have written film thicknesses after a nickel plating layer was formed as an underlayer.

The tin-palladium plated sample was further heated at 300° C., thereby forming an alloy between tin and palladium to obtain a tin-palladium alloy sample. By observing a cross-section and a surface of the obtained sample by a scanning electron microscope (SEM), it was confirmed that both alloy parts and a tin part were exposed on an outermost surface of the tin-old alloy sample and particle diameters of the alloy parts and sizes of continuous regions of the tin part on the outermost surface were sufficiently smaller than the area of an actual contact surface to be brought into contact with a mating contact point when an electrical contact point was formed. Further, it was also confirmed that a part of the nickel plating layer serving as the underlayer formed a nickel-tin alloy.

TABLE 1

| | Sn Film Thickness | Pd Film Thickness | Ni Film Thickness |
|---|---|---|---|
| Sn Plating | 1 μm | — | — |
| Sn/Pd Plating | 1 μm | 0.03 μm | 1 μm (Underlayer) |
| Ni Plating | — | — | 1 μm |

[Fabrication of Electrical Contact Point]

Bulging contact points and plate-like contact points were fabricated using the respective samples obtained above. The bulging contact point was formed by embossing each sample into a shape having a radius of curvature of 3 mm. Further, the obtained samples were directly cut to form the plate-like contact points.

By combining the bulging contact points and the plate-like contact points, electrical contact points according to Example 1 and Comparative Examples 1 and 2 were formed. Combinations of materials of the bulging contact point and the plate-like contact point are as shown in Table 2.

[Testing Method]

[Evaluation of Friction Coefficient]

For each of the electrical contact points according to Example 1 and Comparative Examples 1 and 2, the bulging contact point was brought into contact with the plate-like contact point and slid 5 mm at a speed of 10 mm/min along a surface of the plate-like contact point in a state where a contact load of 5 N was applied. During this sliding movement, a dynamic friction force acting between the contact points was measured using a load cell. Then, a value obtained by dividing the dynamic friction force by the load was set as a (dynamic) friction coefficient.

(Evaluation of Contact Resistance)

For the electrical contact points according to Example 1 and Comparative Examples 1 and 2, contact resistance was measured in a state after the sliding movement was made for the above evaluation of the friction coefficient. The measurement was conducted by a four terminal method while a contact load of 5 N was applied. During this time, an open voltage was set at 100 mV and an energizing current was set at 10 mA.

[Test Results]

Figure 3:
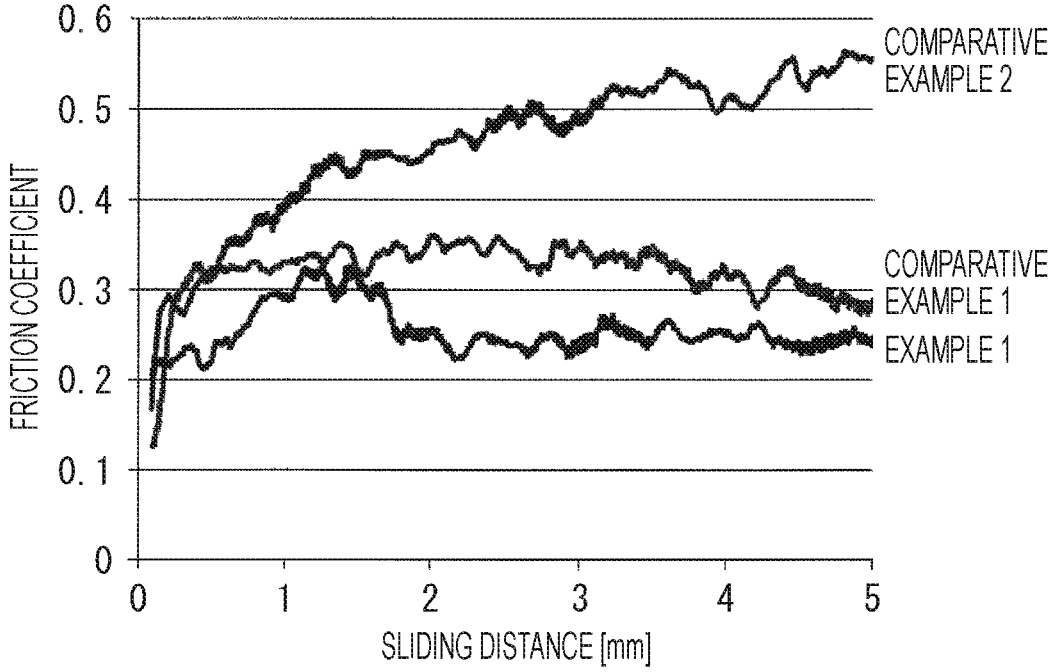
FIG. 3 is a graph showing friction coefficient measurement results for Example 1 and Comparative Examples 1 and 2.

FIG. 3 shows friction coefficient measurement results as functions of a sliding distance. Further, Table 2 below shows measurement results of the friction coefficient and the contact resistance together with a combination of plating materials constituting each contact point. The friction coefficient is shown as an average value over the entire sliding distance except in a very early rising part.

TABLE 2

| | Plating Materials of Contact Points | | Friction | |
|---|---|---|---|---|
| | Bulging Contact Point | Plate-like Contact Point | Coefficient (Average Value) | Contact Resistance [mΩ] |
| Example 1 | Sn—Pd Alloy | Ni Plating | 0.25 | 0.77 |
| C. Example 1 | Sn Plating | Ni Plating | 0.32 | 1.03 |
| C. Example 2 | Sn Plating | Sn Plating | 0.45 | 0.36 |

As understood from FIG. 3 and Table 2, in Example 1 in which the electrical contact point is formed by combining a material having an alloy containing layer (Sn—Pd alloy) containing tin-palladium alloy parts on an outermost surface and a material including a nickel layer on an outermost surface, a notably lower friction coefficient than Comparative Examples 1 and 2 is obtained. In Comparative Example 2 including a layer made of soft and easily adhering tin in both contact points, the friction coefficient is particularly high and the friction coefficient increases as the sliding distance becomes longer. This is because of tin adhesion between the both contact points. In Comparative Example 1, the hard nickel layer is used in one contact point, whereby the friction coefficient is lower than in the case of Comparative Example 2, but a high friction coefficient exceeding 0.30 is still exhibited due to the softness of tin and adhesion between tin and nickel. In contrast to these, in Example 1, the tin-palladium alloy containing layer having a high hardness is included in one contact point and the nickel layer having a high hardness and made of the material containing neither tin nor palladium is included in the other contact point, whereby it is interpreted that a very low friction coefficient is obtained as an effect of the hardness of the both contact points and an effect of eliminating an adhesion phenomenon between metals of the same type.

Next, the contact resistances are compared. In Example 1, a lower value than in Comparative Example 1 is obtained although being higher than in Comparative Example 2. Tin is a metal that provides a very low contact resistance on a surface due to softness and the like, and a lowest contact resistance is obtained in Comparative Example 2 in which the layers made of tin are in contact in the electrical contact point. On the other hand, in Comparative Example 1, tin having such a property is exposed in one contact point, but nickel is exposed in the other contact point, wherefore the contact resistance is high. This is thought to be because a hard oxide film is formed on the surface of nickel and it is difficult to peel off this oxide film by a sliding movement against the tin layer. In contrast, in Example 1, the tin-palladium alloy containing layer having a high hardness is formed in the outermost surface of the contact point to be brought into contact with the contact point in which the nickel layer is exposed, and the oxide film on the nickel surface can be peeled off during a sliding movement. Thus, a metal surface of nickel is exposed and a good electrical contact is formed with the tin-palladium alloy containing layer, particularly with the tin part. As a result, it is interpreted that the contact resistance is lower than in Comparative Example 1. Note that the contact resistance of Example 1 of 0.8 mΩ) can be said to be sufficiently low, for example, for the use in a connector terminal for automotive vehicle.

Although the embodiment of the present disclosure has been described in detail above, the present disclosure is not limited to the above embodiment at all and various changes can be made without departing from the gist of the present disclosure.

The invention claimed is:

1. An electrical contact point comprising:

a first contact and a second contact capable of forming an electrical contact each other, wherein:

the first contact includes an alloy containing layer having alloy parts made of an alloy containing tin and palladium and a tin part made of tin or an alloy having a higher ratio of tin to palladium than the alloy parts with both the alloy parts and the tin part exposed on an outermost surface; and the second contact includes a dissimilar metal layer (i) made of metal having a higher hardness than the alloy containing layer in the first contact and (ii) containing neither tin nor palladium on an outermost surface.

2. The electrical contact point according to claim 1, wherein the dissimilar metal layer is made of nickel or nickel alloy.

3. The electrical contact point according to claim 1, wherein the alloy parts are diffused in the tin part in the alloy containing layer.

4. The electrical contact point according to claim 1, wherein the content of palladium to a total amount of tin and palladium is 7 atom % or lower in the alloy containing layer.

5. The electrical contact point according to claim 1, wherein a volume ratio of the alloy parts occupying the entire alloy containing layer is 1.0 volume % or higher and 95 volume % or lower.

6. The electrical contact point according to claim 1, wherein an area ratio of the alloy parts occupying the outermost surface of the first contact is 1.0% or higher and 95% or lower.

7. The electrical contact point according to claim 1, wherein one of the first and second contacts is a bulging contact having a bulging shape on a surface side; and the other is a plate-like contact having a plate-like shape and configured to electrically contact a top part of the bulging contact.

8. A connector terminal pair, comprising a pair of connector terminals configured to electrically contact each other on contact portions, wherein:

the contact portions include the electrical contact point according to claim 1.

9. A connector pair, comprising the connector terminal pair according to claim 8.

* * * * *